United States Patent [19]

Diaz

[11] Patent Number: 4,833,795

[45] Date of Patent: May 30, 1989

[54] OUTSOLE CONSTRUCTION FOR ATHLETIC SHOE

[75] Inventor: Juan A. Diaz, Weymouth, Mass.

[73] Assignee: Reebok Group International Ltd., Canton, Mass.

[21] Appl. No.: 11,590

[22] Filed: Feb. 6, 1987

[51] Int. Cl.[4] ..... A43B 13/20; A43B 13/18

[52] U.S. Cl. ..... 36/29; 36/11.5; 36/114

[58] Field of Search ..... 36/113, 114, 28, 29, 36/31, 129, 115, 11.5

[56] References Cited

U.S. PATENT DOCUMENTS

| | | | |
|---|---|---|---|
| 545,705 | 9/1895 | MacDonald | 36/29 X |
| 836,364 | 11/1906 | Busby | 36/29 |
| 896,075 | 8/1908 | Badgley | 36/29 X |
| 900,867 | 10/1908 | Miller | 36/37 X |
| 1,498,838 | 6/1924 | Harrison, Jr. | 36/29 |
| 2,090,881 | 8/1937 | Wilson | 36/29 |
| 2,100,492 | 11/1937 | Sindler | 36/29 |
| 2,434,770 | 1/1948 | Lutey | 36/28 |
| 2,468,886 | 5/1949 | Lutey | 36/28 |
| 3,608,215 | 9/1971 | Fukuoka | 36/29 |
| 4,217,705 | 8/1980 | Donzis | 36/29 |
| 4,263,728 | 4/1981 | Frecentese | 36/129 |
| 4,358,902 | 11/1982 | Cole et al. | 36/28 |
| 4,471,538 | 9/1984 | Pomeranz et al. | 36/28 |
| 4,486,964 | 12/1984 | Rudy | 36/28 |
| 4,507,879 | 4/1985 | Dassler | 36/114 |
| 4,536,974 | 8/1985 | Cohen | 36/28 |
| 4,546,556 | 10/1985 | Stubblefield | 36/29 X |
| 4,577,417 | 3/1986 | Cole | 36/28 X |
| 4,593,482 | 6/1986 | Mayer | 36/29 X |
| 4,611,412 | 9/1986 | Cohen | 36/28 |
| 4,670,995 | 6/1987 | Huang | 36/29 |
| 4,670,997 | 6/1987 | Beekman | 36/114 |

*Primary Examiner*—Donald Watkins

*Attorney, Agent, or Firm*—Saidman, Sterne, Kessler & Goldstein

[57] ABSTRACT

An outsole construction includes a forefoot cushion section in the forefoot region and a heel cushion section in the heel region, each surrounded by a stabilizing platform section. The cushion sections include a plurality of resilient, hollow ribs which extend at least slightly below the bottom surface of the platform section when not in contact with the ground. The platform section is preferably made of a harder material than the cushion sections to achieve a desired compromise between stability and cushioning. A pivot surface can be located in the ball portion of the forefoot region to facilitate pivoting as the foot contacts the ground. The pivot surface defines a cushioning air pocket between the outsole and the midsole.

13 Claims, 2 Drawing Sheets

OUTSOLE CONSTRUCTION FOR ATHLETIC SHOE

FIELD OF THE INVENTION

This invention relates to footwear and, more particularly, to footwear having an outsole construction which cushions impact and provides a stable platform for support of the wearer. The outsole construction is intended for use in athletic shoes, but is not limited to such use.

BACKGROUND OF THE INVENTION

In activities such as aerobics, running, tennis and basketball, a considerable shock force is transmitted through the shoe to the wearer's foot each time the foot contacts the ground. After a time, this shock force can result in fatigue, discomfort and injury. Various shoe constructions with cushioned soles have been utilized to absorb at least a portion of the shock and to thereby overcome this problem. Conversely, the cushioned sole must avoid destabilizing the foot and must maintain a stable support platform for the wearer. Excessively soft or nonuniform cushioned soles are unacceptable. In addition, the above-mentioned activities frequently require pivoting or rotation as the foot contacts the ground. A well-designed athletic shoe must permit the wearer to pivot easily.

A variety of cushioned shoe designs have been disclosed in the prior art. Shoes having hollow tubes, or chambers, to provide cushioning effects are shown in U.S. Pat. Nos. 900,867 issued Oct. 13, 1908; 545,705 issued Sept. 3, 1895; 4,593,482 issued June 10, 1986; 4,536,974 issued Aug. 27, 1985; 2,100,492 issued Nov. 30, 1937; 1,498,838 issued June 24, 1924; 4,486,964 issued Dec. 11, 1984 and 4,546,556 issued Oct. 15, 1985. The prior art cushioned soles have a number of disadvantages including reducing the stability of the shoe, adding unacceptable height to the sole, which can result in instability, excessive complexity and high manufacturing costs.

It is a general object of the present invention to provide improved footwear.

It is another object of the present invention to provide an athletic shoe which cushions impact while maintaining foot stability.

It is a further object of the present invention to provide a cushioned athletic shoe having a pivot area which facilitates pivoting of the foot upon contact with the ground.

It is yet another object of the present invention to provide an athletic shoe with a stable cushioned sole which limits fatigue and injuries to the wearer.

SUMMARY OF THE INVENTION

According to the present invention, these and other objects are achieved in footwear comprising an upper and a sole, the sole including a midsole and an outsole having a heel region and a forefoot region. The outsole includes a forefoot cushion section in the forefoot region and a stabilizing platform section surrounding the cushion section. The cushion section including a plurality of resilient, hollow ribs which extend at least slightly below the bottom surface of the platform section when not in contact with the ground. Preferably, the outsole further includes a heel cushion section in the heel region comprising a plurality of resilient, hollow ribs and the platform section surrounds both the forefoot cushion section and the heel cushion section.

In a preferred embodiment, the platform section which surrounds the cushion sections is made of a harder material than the hollow ribs so as to achieve a desired compromise between stability and cushioning. In a preferred embodiment, the hollow ribs are parallel to each other and are oriented generally perpendicular to the toe to heel direction so as to assist in forward traction. The ribs can further include a plurality of holes in the surfaces of the ribs which contact the ground to enhance traction, particularly in the lateral and medial directions.

In a further feature of the invention, the cushion section includes a pivot surface located in the ball portion of the forefoot region. The pivot surface extends slightly below the surfaces of the hollow ribs which contact the ground and defines a cushioning air pocket between the outsole and the midsole. The pivot surface permits simultaneous rotation and cushioning upon contact with the ground.

BRIEF DESCRIPTION OF THE DRAWINGS

For a better understanding of the present invention together with other and further objects, advantages and capabilities thereof, reference is made to the accompanying drawings which are incorporated herein by reference and in which.

DETAILED DESCRIPTION OF THE INVENTION

Figure 1:
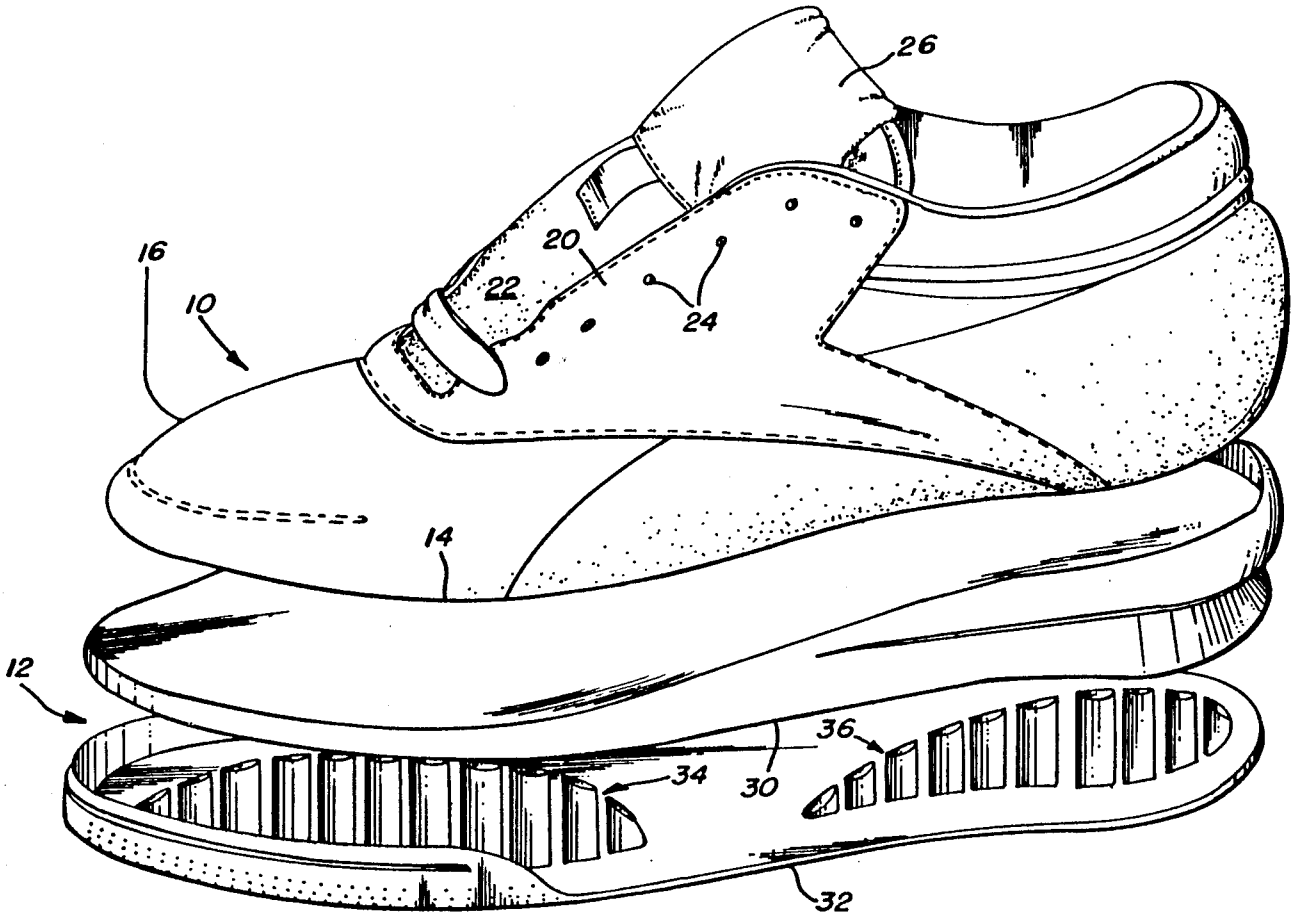
FIG. 1 is an exploded view of an athletic shoe incorporating a sole construction in accordance with the present invention.

A lightweight athletic shoe suitable for incorporation of the present invention is shown in FIG. 1. An upper 10 is joined to a sole 12 at a lasting margin 14. A top 16, or vamp, of a light, flexible material such as leather extends from the rear of the heel along the sides and covers the toe portion. A U-shaped lacing margin 20 is stitched to the top and defines a lacing opening 22. The lacing margin is provided with a plurality of lacing holes 24. A tongue 26 underlies the lacing margin 20 and the lacing opening 22. The sole 12 includes a midsole 30 and an outsole 32. The sole of the present invention can be utilized generally in any type of footwear such as, for example, an athletic shoe with hook and loop-type fasteners such as Velcro fasteners. The midsole 30 is of conventional construction and can be molded of ethyl vinyl acetate.

Figure 2:
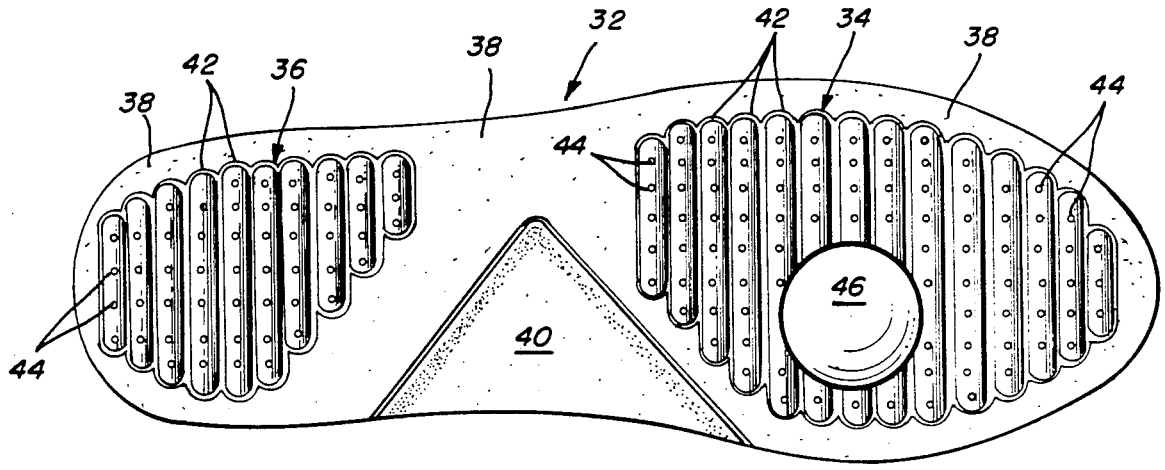
FIG. 2 is a bottom view of an outsole in accordance with the present invention.
Figure 3:
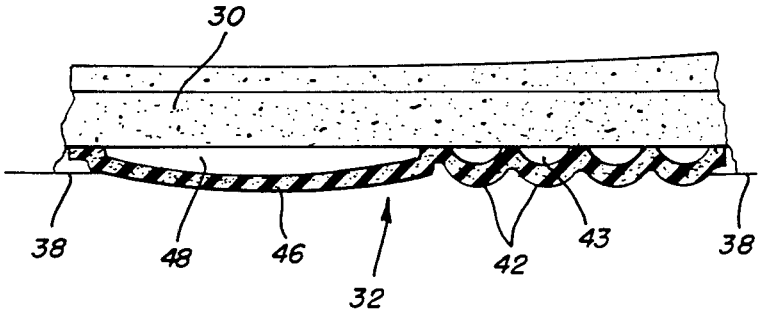
FIG. 3 is a partial cross-sectional view of the sole in accordance with the present invention.

The outsole 32 of the present invention is shown in FIGS. 2 and 3. A forefoot cushion section 34 and a heel cushion section 36 are both surrounded by a stabilizing platform section 38 which forms a peripheral edge area around cushion sections 34 and 36 and typically includes a substantial area in an arch region 40 of the outsole 32. Each of the cushion sections 34, 36 includes a plurality of resilient, hollow ribs 42 which are oriented generally perpendicular to the toe to heel direction of the shoe.

The ribs 42 run parallel to each other and each comprises a generally semicircular tube with a hollow, air-filled interior 43. Preferably, the hollow ribs 42 have a wall thickness in the range of about 1.2 mm to 4.0 mm.

As illustrated in FIG. 3, the thickness of the material used to form the discrete hollow ribs 42 may be substantially a uniform thickness. The hollow ribs 42 are cemented to the midsole 30. A plurality of holes 44 is provided in each rib 40 in the surface which contacts the ground. The holes 44 do not extend to the interior 43 of the tubular cross-section of the rib 42. It is preferred that the cushion sections 34, 36 be made of a relatively softer material than the platform section 38 and that the cushion sections 34, 36 extend slightly below the surface of the platform section 38 when the shoe is not in contact with the ground. In a preferred embodiment, the ribs 42 extend about 1 mm below the surface of platform section 38. With this construction, the cushion sections 34, 36 deform upon contact of the foot with the ground until they become flush with the surface of the platform section 38. At this point, a stable platform for support of the foot is provided.

In a preferred embodiment, the cushion sections have a hardness in the range between 60 and 65 Asker C durometer and the platform section 38 has a hardness in the range between 65 and 70 Asker C durometer. The outsole 32 preferably is made of rubber but can be made of any other suitable outsole material such as ethyl vinyl acetate or polyurethane.

The outsole 32 of the present invention further includes a pivot surface 46 located in the ball portion of the forefoot region and within the forefoot cushion section 34. The pivot surface 46 defines an air space 48 between the midsole 30 and the outsole 32 which cushions impact. The lowermost surface of the pivot surface 46 extends slightly below the surfaces of the hollow ribs 42 which contact the ground so that the pivot surface 46 is the first to contact the ground. The pivot surface 46 construction permits the shoe to be rotated as the shoe contacts the ground and simultaneously provides cushioning by collapse of the air space 48.

The cushion sections 34, 36 assist in forward traction because the ribs 42 are oriented perpendicular to the forward direction. Lateral and medial traction is enhanced by the holes 44 in each of the hollow ribs 42.

It will be understood that the cushion section can have other configurations. For example, the cushion section can extend over a major portion of the outsole, or the heel cushion section 36 can be omitted since the primary need for cushioning in many activities is in the forefoot region. Furthermore, the pivot surface 46 can be omitted if pivoting is not required in a particular activity. The hollow ribs 42 are not necessarily semicircular in cross-section, but can have other suitable shapes which will deform upon impact. In addition, the pockets of air need not extend across the width of the shoe. FIG. 2 illustrates one embodiment of the invention where some of the ribs 42 or air filled pockets extend only a short distance across the width of outsole 32.

Thus, there is provided an outsole construction for an athletic shoe or other footwear which combines cushioning with stability and does not add significantly to the overall sole thickness. Therefore, both comfort and stability are enhanced and the possibility of fatigue and injury is limited.

While there has been shown and described what is at present considered the preferred embodiments of the present invention, it will be obvious to those skilled in the art that various changes and modifications may be made therein without departing from the scope of the invention as defined by the appended claims.

What is claimed is:

1. Footwear comprising:

an upper and a sole, said sole including a midsole and an outsole having a heel region and a forefoot region, said outsole including a cushion section and a stabilizing platform section surrounding said cushion section, said cushion section including a plurality of resilient, hollow ribs which extend at least slightly below the bottom surface of the platform section and wherein the bottom surface of said platform section is below a portion of at least one of said resilient, hollow ribs.

2. Footwear comprising:

an upper and a sole, said sole including a midsole and an outsole having a heel region and a forefoot region, said outsole including a cushion section and a stabilizing platform section surrounding said cushion section, said cushion section including a plurality of resilient, hollow ribs which extend at least slightly below the bottom surface of the platform section wherein said platform section is made of a harder material than said hollow ribs.

3. Footwear as defined in claim 1 wherein said hollow ribs are parallel to each other and are oriented generally perpendicular to the toe to heel direction so as to assist in forward traction.

4. Footwear as defined in claim 2 wherein said cushion section includes a pivot surface located in the ball portion of said forefoot region, said pivot surface extending slightly below the surfaces of said hollow ribs which contact the ground and defining an air pocket between said outsole and said midsole, whereby said pivot surface permits simultaneous rotation and cushioning upon contact with the ground.

5. Footwear as defined in claim 2 wherein said hollow ribs include a plurality of holes in the surface of said ribs which contact the ground to enhance traction, particularly in the lateral and medial directions.

6. Footwear as defined in claim 2 wherein said platform section has a hardness in the range between 65 and 70 Asker C durometer and said cushion section has a hardness in the range between 60 and 65 Asker C durometer.

7. Footwear as defined in claim 2 wherein said hollow ribs comprise semicircular tubes having a wall thickness in the range of about 1.2 mm to 4.0 mm.

8. A shoe, comprising:

a. an upper; and b. a sole attached to said upper and including a midsole and an outsole, said outsole having an inner surface and an outer surface wherein said outsole is shaped to define discrete air-filled pockets between said inner surface and said midsole, said insole forming an upper boundary of said air pockets.

9. The shoe as defined in claim 8, wherein thickness of the material forming the outsole is substantially constant.

10. The shoe as defined in claim 8, wherein said plurality of discrete air-filled pockets are semi-circular in cross section and extend in a direction along the width of the shoe.

11. Footwear as defined in claim 1 wherein said cushion section is in said forefoot region of said outsole.

12. Footwear as defined in claim 1 wherein said cushion section is in said heel region of said outsole.

13. Footwear as defined in claim 1 wherein said cushion section is in both heel region and said forefoot region of said outsole.

* * * * *

UNITED STATES PATENT AND TRADEMARK OFFICE

CERTIFICATE OF CORRECTION

PATENT NO. : 4,833,795

DATED : May 30, 1989

INVENTOR(S) : Juan A. Diaz

It is certified that error appears in the above-identified patent and that said Letters Patent is hereby corrected as shown below:

On the title page, after [73] Assignee: delete "Group"

At column 3, line 5, delete "40" and insert --42--;
At column 4, line 35, delete "surface" and insert --surfaces--;
At column 4, line 52, delete "insole" and insert --midsole--.

Signed and Sealed this

Tenth Day of April, 1990

*Attest:*

HARRY F. MANBECK, JR.

*Attesting Officer*

*Commissioner of Patents and Trademarks*